United States Patent [19]

Slade

[11] Patent Number: 4,757,166

[45] Date of Patent: Jul. 12, 1988

[54] VACUUM INTERRUPTER WITH CERAMIC ENCLOSURE

[75] Inventor: Paul G. Slade, Churchill Boro, Pa.

[73] Assignee: Westinghouse Electric Corp., Pittsburgh, Pa.

[21] Appl. No.: 61,768

[22] Filed: Jun. 15, 1987

[51] Int. Cl.[4] ..... H01H 33/66

[52] U.S. Cl. ..... 200/144 B

[58] Field of Search ..... 200/144 B, 144 BA

[56] References Cited

U.S. PATENT DOCUMENTS

| | | | |
|---|---|---|---|
| 1,935,228 | 11/1933 | Kopeliowitsch | 200/144 B |
| 2,480,622 | 8/1949 | Warnock | 200/144 B |
| 2,773,154 | 12/1956 | Williams | 200/144 B |
| 2,965,734 | 12/1960 | Timmerman | 200/144 B |
| 3,261,954 | 7/1966 | Yonkers | 200/144 B |
| 3,727,018 | 4/1973 | Wesoloski | 200/144 B |
| 3,761,761 | 9/1973 | Van Oostrom | 200/144 B |
| 3,818,163 | 7/1974 | Robinson | 200/144 B |
| 3,924,087 | 12/1975 | Clason | 200/144 BA |
| 3,944,771 | 3/1976 | Kohler | 200/144 B |
| 4,431,885 | 2/1984 | Skuma | 200/144 B |
| 4,438,307 | 3/1984 | Lippmann | 200/144 B |
| 4,450,327 | 5/1984 | Yanagisawa | 200/148 B |
| 4,540,863 | 9/1985 | Bettge | 200/144 B |
| 4,630,361 | 12/1986 | Inagaki | 29/662 |

FOREIGN PATENT DOCUMENTS

| | | | |
|---|---|---|---|
| 223869 | 11/1968 | U.S.S.R. | 200/144 B |

*Primary Examiner*—Robert S. Macon

*Attorney, Agent, or Firm*—L. P. Johns

[57] ABSTRACT

A vacuum interrupter characterized by an all-ceramic envelope forming an evacuated chamber in which a pair of separable contacts are disposed. The envelope is comprised of two substantially half portions having abutting end surfaces that are secured together in a vacuum-tight manner.

1 Claim, 2 Drawing Sheets

VACUUM INTERRUPTER WITH CERAMIC ENCLOSURE

BACKGROUND OF THE INVENTION

1. Field of the Invention

This invention pertains to a vacuum interrupter and, more particularly, it pertains to a vacuum interrupter having an all ceramic enclosure.

2. Description of the Prior Art

Vacuum interrupters for electric circuits are comprised of an evacuated envelope in which a pair of separable electrical contacts are disposed for opening and closing a circuit. The envelope usually comprises a tubular housing and a pair of end plates. Generally, the tubular housing is comprised of a pair of cylindrical tubes made from an insulated material and end plates composed of metal. Examples of such vacuum interrupter are disclosed in U.S. Pat. Nos. 3,727,018; 3,818,163; 4,431,885; 4,438,307; 4,450,327; 4,540,863; and 4,630,361.

During opening of the contacts within the interrupter, an arc occurs between the contacts which is accompanied by a high temperature at the arc roots on the contact surface. As a result the contact metal vaporizes and produces metallic vapor and particles which disperse in all directions and deposit upon the interior surface of the envelope. Repeated opening operations of the contact would ultimately cause a metallic deposit on the insulating housing which would extend from one metal end plate to the other, thereby causing short circuiting conditions. For that reason, shields must be provided within the vacuum interrupter for preventing condensation and deposit of the metal particles on the interior insulating surfaces of the interrupter.

Associated with the foregoing is an additional precaution of replacing the metal end wall with insulating material, such as the ceramic material or glass, as disclosed in U.S. Pat. No. 3,944,771, whereby overcurrent protection is increased. Notwithstanding the advantages of a structure which eliminates metal end walls there is a need for a novel vacuum interrupter design and manufacturing technique therefor.

SUMMARY OF THE INVENTION

In accordance with this invention, it has been found that a vacuum interrupter may be provided comprising an envelope forming an evacuated chamber, a pair of separable electrical contacts within the envelope which contacts are conducive to the production of metal vapor during opening thereof, the envelope being an all-enclosing container and composed of a non-metallic material, such as a ceramic or glass, the envelope being comprised of at least two envelope portions having abutting surfaces secured together in a vacuum-tight manner, such as brazing, the envelope portions preferably comprising a pair of cup-shaped members having integral side and end walls, and a shielding device disposed around the contacts to avoid metal vapor deposition on the inner surface of the envelope.

The advantage of the vacuum interrupter of this invention is that it provides a new and novel assembly of envelope portions using a manufacturing technique at a relatively low cost.

DESCRIPTION OF THE PREFERRED EMBODIMENT

Figure 1:
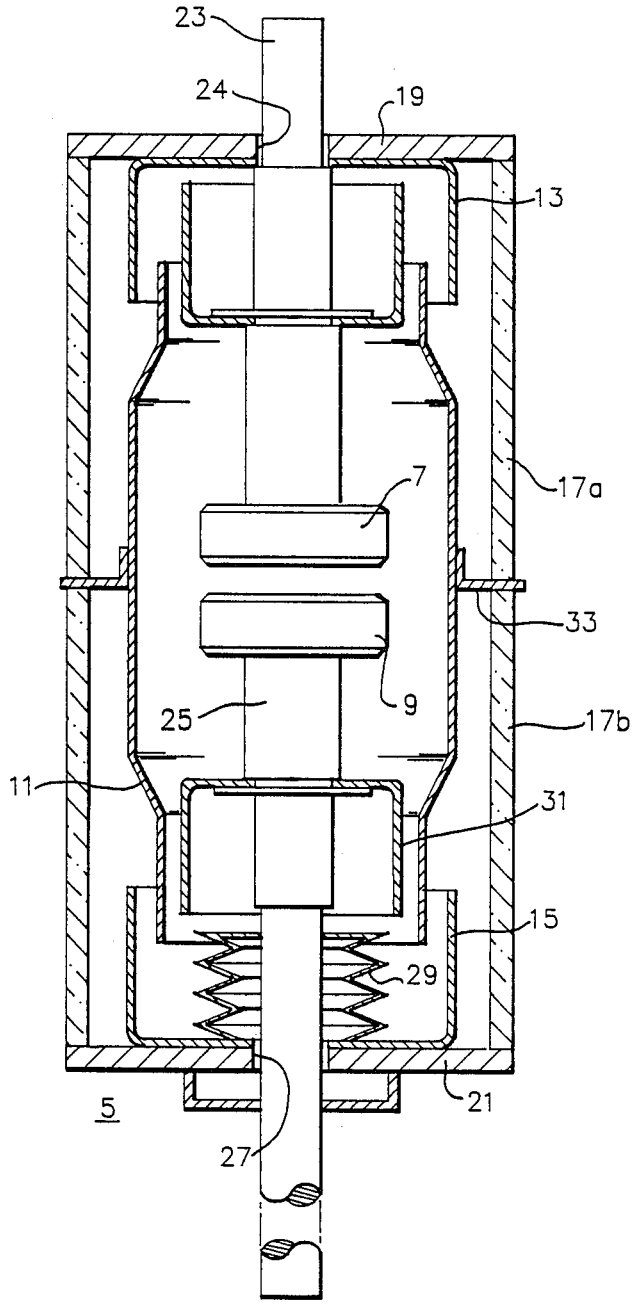
FIG. 1 PRIOR ART
FIG. 1 is a vertical sectional view of a vacuum interrupter of prior art construction.

A vacuum interrupter of prior art construction is generally indicated at 5 in FIG. 1. It comprises a pair of separable contacts or electrodes 7, 9, vapor condensation shields 11, 13, 15, an insulating envelope consisting of two ceramic or glass cylinders 17*a* and 17*b*, and end plates 19, 21. The contact 7 is supported on a fixed stem or conductor 23 and extends through a hole in the metal end wall 19 where it is secured at 24 in a vacuum-tight manner such as by brazing. A metallic movable contact 9 is mounted on a movable stem or conductor 25 which extends through an opening 27 and a metal end plate 21. To avoid leakage into the evacuated interior of the interrupter, bellows 29 extend between the metal end plate 21 and a bellows shield 31 on the movable stem 25 in the conventional manner. The vapor condensation shield 11 is secured in place by a shield support flange 33 which is mounted at the junction of the two insulating cylinders that form the envelope 17.

The end shields 13, 15 are secured in place in a suitable manner, such as brazing, to the respective metal end plates 19, 21. Accordingly, the vacuum interrupter 5 provides for an insulating envelope 17, which can be formed by brazing two ceramic cylinders together and which extends between the metal end plates 19, 21. In accordance with existing procedure, the several shields including shields 11, 13, 15 provide condensation surfaces for any metal vapor generated by the metal contacts 7, 9 when the contacts are separated to the open condition as shown in FIG. 1. In this manner most of the metal vapor is not deposited on the inner surface of the insulating envelope 17 which would otherwise ultimately create a metal path between the metal end plates 19, 21 and thereby incur short circuiting between.

Figure 2:
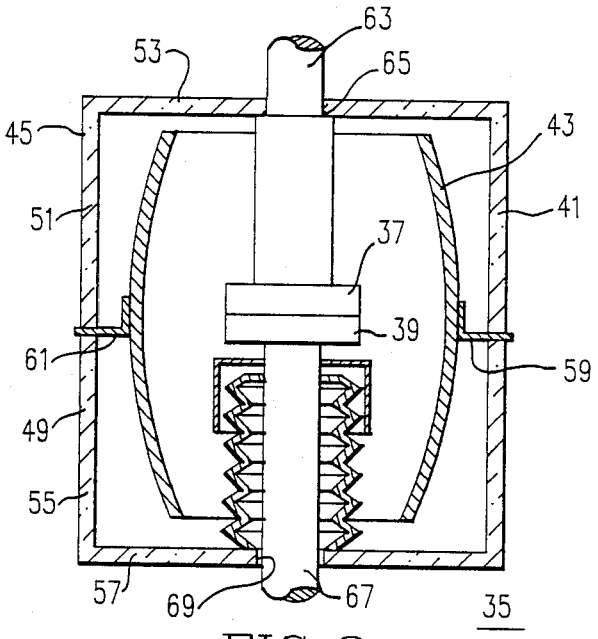
FIG. 2 is a vertical sectional view of a vacuum interrupter constructed with a floating shield and with two-shaped ceramic envelope portions in accordance with this invention.

In accordance with this invention, a vacuum interrupter is generally indicated at 35 in FIG. 2, and it comprises a pair of separable metal contacts 37, 39, an insulating envelope 41, and a vapor condensation shield 43. The envelope 41 is comprised of a pair of envelope portions 45, 49. Each envelope portion has a cup-like configuration with the portion 45 including cylindrical wall 51 and end wall 53. Similarly, the portion 49 includes a cylindrical wall 55 and an end wall 57. The envelope portion 45, 49 are comprised of an insulating material, such as ceramic or glass. The envelope 41 may also be comprised of a cylindrical portion which includes the cylindrical walls 51, 55 plus separate end walls which are not integral with the cylindrical portion, but which are bonded thereto in a manner to be described.

For the particular structure as shown in FIG. 2 the cylindrical walls 51, 55 are secured together at a joint 59. For the purpose of preparing for the joint, the end walls of the cylindrical portions 51, 55 are preliminary ground to a desired smooth surface after which a coating of a brazing metal is applied to each surface. The end surfaces are then placed together and brazed in a conventional manner to form the vacuum-tight joint 59. The foregoing is a procedure where the shield 43 is not provided or necessary, such as where a current passing through the contact 37, 39 is very low and very few operations are required. In such case, the contacts provide little, if any, arcing and resulting metal vapor during separation for which reason the shield 43 may be unnecessary. Under normal circumstances where currents of higher amperage are usually sustained and the device interrupts the electrical circuit with some frequency, the shield 43 of a suitable material, such as metal, to withstand the high thermal stresses incurred during arcing, is mounted in place by means of a peripheral shield support flange 61 which is mounted between the abutting ends of the cylindrical walls 51, 55 during assembly. For that purpose, the flange 61 is brazed in place between the abutting cylindrical walls.

The contact 37 is mounted on a fixed conductor 63 which extends through an opening in the end wall 53 where it is secured in a vacuum-tight manner by a brazed seal or glass frit seal between the ceramic wall 53 and the conductor 63 is generally indicated at 65. If there is a problem of differential expansion between the stem 63 and the ceramic wall 53, an intermediate, thin-wall holder could be brazed between them. The movable contact 39 is mounted on a movable conductor 67 which extends through a hole 69 in the end wall 57. A bellows 71 is provided between the end wall 57 and the conductor 67 to maintain vacuum conditions within the interrupter 35.

Figure 3:
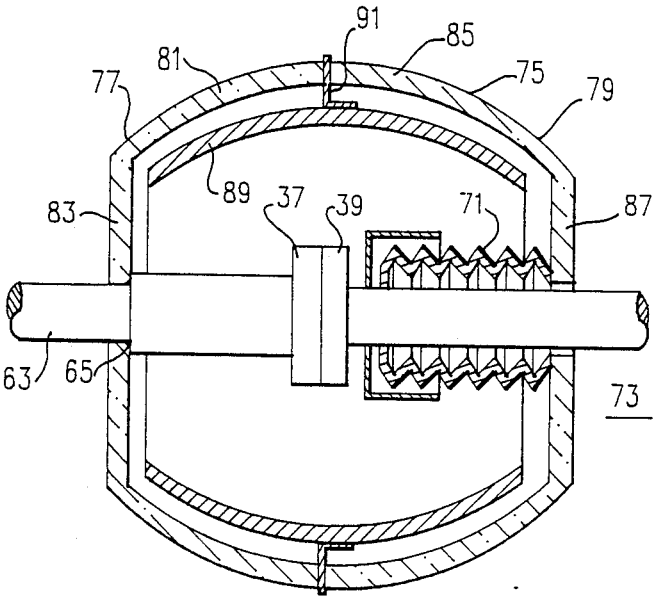
FIG. 3 is a sectional view through another embodiment of the shaped ceramic vacuum interrupter as shown in FIG. 2.

Another embodiment 73 is disclosed in FIG. 3 with similar numerals referring to similar parts. In FIG. 3 an envelope 75 which is comprised of an insulating material, such as ceramic, includes a pair of similar half portions 77, 79. The half portions 77 includes side wall 81 having an arcuate configuration and being integral with an end wall 83. Likewise, the half portion 79 includes a sidewall 85 having an arcuate configuration and being integral with an end wall 87.

A vapor condensation shield 89 which conforms with the configuration of the sidewalls 81, 85 is mounted within the envelope on a flange 91 in a manner similar to that of the flange 61 in FIG. 2. Although the conductors 63, 67 are horizontally disposed in FIG. 3, they may be vertically disposed as shown in FIG. 2.

The basic concept of this invention is shown in FIG. 2. The ceramic envelope is formed into a pair of cup-like portions with a hole in the base through which the electrode stems extend. This type of design eliminates the need for the metal end walls. The stem 63 which hold the fixed contact 37 in place is sealed in place in the end wall 53. Bellows 71 are provided for the end wall 57 to maintain the vacuum atmosphere within the assembled envelope 41. Suffice it to say, the ceramic end walls provide a more reliable structure by eliminating metal end flanges and the manufacturing step of having to braze them to the insulating envelope.

In conclusion, a novel construction technique for vacuum interrupters is provided with shaped ceramic cup-like members employed in place of the conventional cylindrical ceramics. By using cup-shaped ceramics, it is possible to eliminate the metal end flanges and also to introduce novel vacuum interrupter designs and manufacturing techniques.

What is claimed is:

1. A vacuum interrupter comprising:

an envelope forming an evacuated chamber;

a pair of separable electrical contacts within the envelope;

the envelope being an all-enclosing container and being composed of a ceramic material, the envelope being comprised of two cup portions having integral side and end walls and having abutting end surfaces secured together in a vacuum-tight joint, the contacts being conducive to the production of metal vapor during opening of the contacts and in which a shielding device is disposed around the contacts to avoid metal vapor deposition on the envelope, and the contacts being supported on support conductors extending through the end walls of the envelope.

* * * * *